US005767617A

United States Patent [19]

Wharmby et al.

[11] Patent Number: 5,767,617

[45] Date of Patent: Jun. 16, 1998

[54] ELECTRODELESS FLUORESCENT LAMP HAVING A REDUCED RUN-UP TIME

[75] Inventors: David O. Wharmby, Ben Rhydding, England; Zoltan Toth, Monor; Istvan Nagy, Budapest, both of Hungary

[73] Assignee: General Electric Company, Schenectady, N.Y.

[21] Appl. No.: 730,798

[22] Filed: Oct. 17, 1996

[30] Foreign Application Priority Data

Oct. 18, 1995 [GB] United Kingdom ..... 9521375

[51] Int. Cl.[6] ..... H01J 65/00; H01J 65/04

[52] U.S. Cl. ..... 313/489; 313/490; 313/492

[58] Field of Search ..... 313/489, 490, 313/493, 491, 492, 153, 547, 550; 315/248

[56] References Cited

U.S. PATENT DOCUMENTS

| | | | |
|---|---|---|---|
| 4,262,231 | 4/1981 | Anderson et al. | 313/490 |
| 4,622,495 | 11/1986 | Smeelen . | |
| 5,258,689 | 11/1993 | Jansma et al. | 313/489 |
| 5,412,280 | 5/1995 | Scott et al. . | |
| 5,412,288 | 5/1995 | Borowiec et al. . | |
| 5,629,584 | 5/1997 | Borowiec et al. | 313/490 |

FOREIGN PATENT DOCUMENTS

| | | |
|---|---|---|
| 646942 | 9/1994 | European Pat. Off. . |
| 660375 | 11/1994 | European Pat. Off. . |
| 1192999 | 5/1968 | United Kingdom . |
| 1319105 | 7/1970 | United Kingdom . |

*Primary Examiner*—Sandra L. O'Shea
*Assistant Examiner*—Joseph Williams
*Attorney, Agent, or Firm*—Fay, Sharpe, Beall, Fagan, Minnich & McKee

[57] ABSTRACT

An electrodeless fluorescent lamp comprises a discharge vessel (10) having a re-entrant portion (11) for housing a solenoid (12) for initiating a discharge in the vessel by means of an RF electromagnetic field. A primary amalgam (18) for releasing mercury vapor is placed at the tip of an exhaust tube (17) where the primary amalgam can be maintained at a suitable temperature for controlling the mercury vapor pressure. The primary amalgam does not provide rapid run-up of light output. To provide rapid run-up of light output a pied of indium (20.30) is placed on the re-entrant at a position where it is rapidly heated by the discharge. The indium may be coated with the layers of a coating including phosphor.

20 Claims, 3 Drawing Sheets

ELECTRODELESS FLUORESCENT LAMP HAVING A REDUCED RUN-UP TIME

BACKGROUND OF THE INVENTION

The present invention relates to an electrodeless fluorescent lamp.

Such a lamp is disclosed in EP-A-646,942 (General Electric Company—RD-23176). The lamp comprises a discharge vessel having a re-entrant portion containing a solenoid energised with an RF current. A discharge is induced in a fill in the vessel. The fill includes mercury vapor. The source of the mercury vapor is an amalgam. The light output is dependent on mercury vapour pressure which is dependent on the temperature of the amalgam.

The amalgam is located at the tip of an exhaust tube of the vessel remote from the discharge. The amalgam is thus located where the temperature is stable and appropriate for optimum vapor pressure and light output.

In production versions of the lamp, however, the amalgam does not reach the optimum operating temperature until the lamp has been switched on for many minutes, e.g. 30 minutes. The light output is visibly low for a period known as the run-up time which may be as long as 10 minutes. This is acceptable for commercial and industrial uses where the lamp is on continuously for periods of time much longer than the run-up time.

However, for domestic use and for commercial uses such as in hotel rooms where the lamp would be switched on and off intermittently, the long run-up time is not acceptable.

U.S. Pat. No. 4,622,495 (Philips) also discloses an electrodeless fluorescent lamp having a discharge vessel with a re-entrant portion containing a solenoid energised by an RF current.

To minimise run-up time, U.S. Pat. No. 4,622,495 discloses the use of amalgam on a holder placed in the discharge. The holder is fixed to the wall of the re-entrant portion by a support member, e.g. wire. The wire is secured to the wall by means of, for example, glass enamel. This is very difficult to achieve in practice especially in mass-production of lamps. U.S. Pat. No. 4,622,495 observes that "the amalgam should not be disposed on . . . a wall part (i.e. the re-entrant portion) around the core (i.e. the solenoid)" because "it has been found that the temperature of this part is too low to obtain the desired effect". The lamp of U.S. Pat. No. 4,622,495 also has a second or main amalgam for regulating mercury vapor pressure during operation of the lamp. This second amalgam is disposed at a comparatively cool area on the inner wall of the discharge vessel.

GB-A-1,192,999 and GB-A-1,319,105 (Patent-Treuhand) disclose fluorescent lamps having electrodes, and which use amalgam as a source of mercury vapor. Both documents disclose a variety of locations for amalgam within such a fluorescent lamp. The locations include inter alia: providing the amalgam "on the inner wall of the discharge, vessel in the form of a streak, a film, or a pellet" (GB-A-1,192,999); and "the application of Indium in the form of a strip covering the inner circumference of the bulb wall in the middle of the lamp" (GB-A-1,319,105).

Both documents disclose the use of a primary amalgam by which the mercury vapor pressure during normal lamp operation is determined and a secondary amalgam effecting a reduction of the run-up time.

In both documents, the primary amalgam is located at the base of a glass stem supporting an electrode. The secondary amalgam is located on a metal shield surrounding the electrode so that it is heated quickly.

SUMMARY OF THE INVENTION

According to one aspect of the present invention there is provided an electrodeless fluorescent lamp comprising: a discharge vessel having a re-entrant portion containing a solenoid for energising a discharge in the vessel with an RF electromagnetic field, a primary amalgam located remotely from the discharge, and a secondary amalgam on the re-entrant portion adjacent the discharge.

In an embodiment of the invention, the secondary amalgam is coated with at least phosphor. Furthermore, at least a layer of material as known in the art which prevents blackening of the glass may overlay the secondary amalgam, the phosphor being on the blackening prevention material. It has been found, surprisingly, that the secondary amalgam releases and reabsorbs mercury despite the coating of phosphor and, if present, blackening prevention material.

In a preferred embodiment of the invention, an exhaust tube extends through the re-entrant portion, one end of the exhaust tube being in communication with the discharge vessel, the other end being sealed, and the sealed end holds the primary amalgam. The primary amalgam is the source of the mercury in the secondary amalgam. Because the primary amalgam is in the end of the exhaust tube, the probability of mercury vapor re-amalgamating in the secondary amalgam is higher than the probability of re-amalgamating in the primary amalgam.

According to another aspect of the invention, there is provided an electrodeless fluorescent lamp comprising a closed discharge vessel, material on the internal wall of the vessel for forming an amalgam to act as a source of mercury vapor for a discharge in the vessel, and a coating over the Indium, the coating comprising at least one or more of:

(a) an electrically conductive light transmissive layer;

(b) a layer of material which prevents blackening of the vessel;

(c) phosphor, and (d) light reflective material.

BRIEF DESCRIPTION OF THE DRAWING

For a better understanding of the present invention and to show how the same may be carried into effect, reference will now be made, by way of example, to the accompanying drawings, in which.

DETAILED DESCRIPTION OF THE PREFERRED EMBODIMENTS

Figure 1:
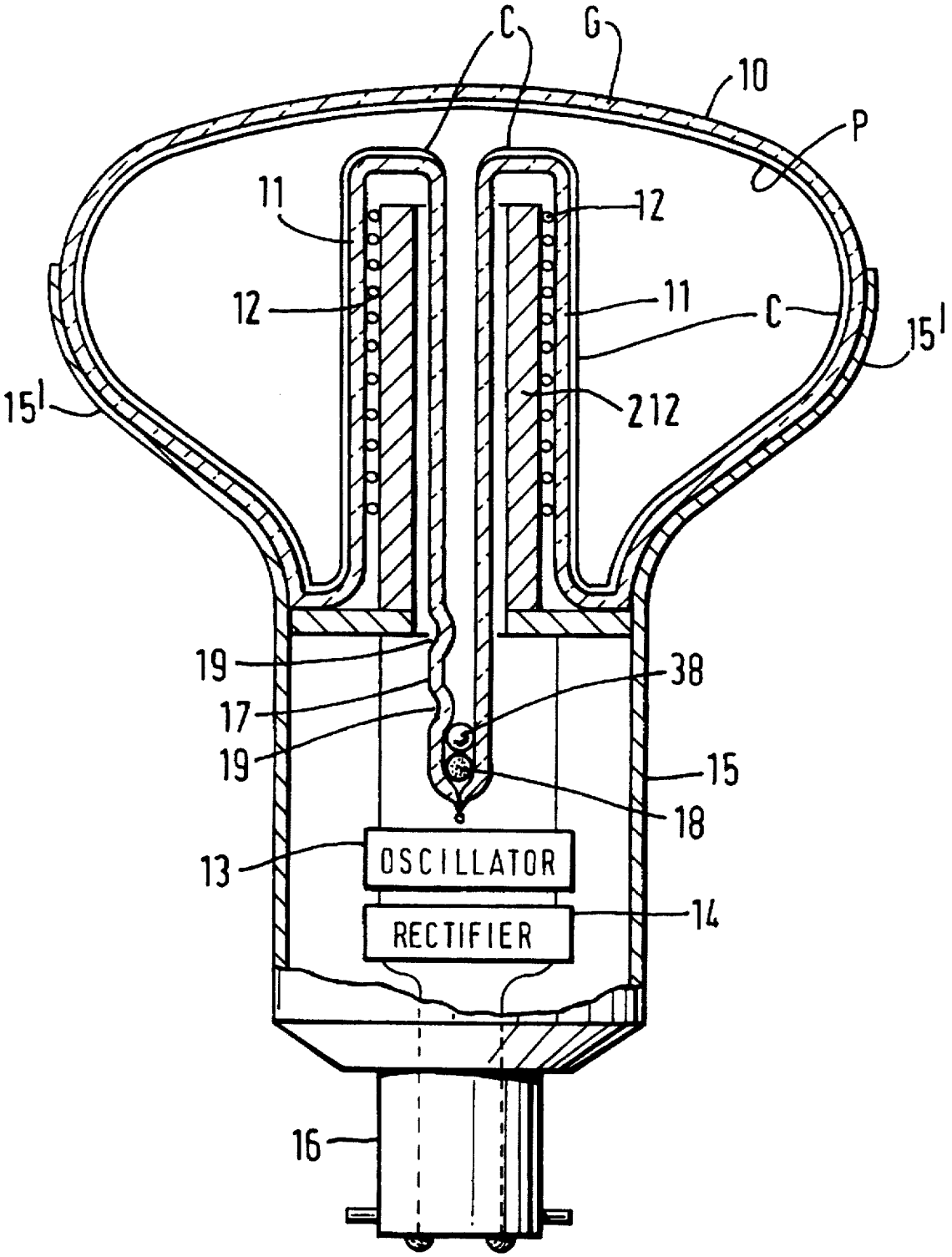
FIG. 1 PRIOR ART
FIG. 1 is a schematic cross-sectional view of an illustrative electrodeless fluorescent lamp.

Referring to FIG. 1 an electrodeless fluorescent lamp comprises a sealed discharge vessel 10 of glass, G. The vessel has a re-entrant portion 11 housing a solenoid 12 wound on an annular ferrite core 212 which when suitably energised creates a radio frequency (RF) magnetic field within the vessel 10 to excite a discharge in a fill comprising rare-gas and mercury vapor within the vessel. The discharge produces ultra-violet (UV) radiation which excites phosphor P on the internal surface of the vessel to produce light which is transmitted through the glass vessel 10.

The solenoid 12 is energised by an RF oscillator 13 operating at, for example 2.65 MHz. The oscillator is powered from the mains via a rectifier 14.

The oscillator 13 and rectifier 14 are housed in, and supported in, an insulative housing 15. The solenoid 12 is fixed to a circuit board which is also supported in the housing. A lamp cap 16 which may be a bayonet cap or an Edison-screw cap is connected to the housing.

In the lamp shown in FIG. 1, the insulative housing 15 extends as shown at 15' around the discharge vessel 10.

Figure 4:
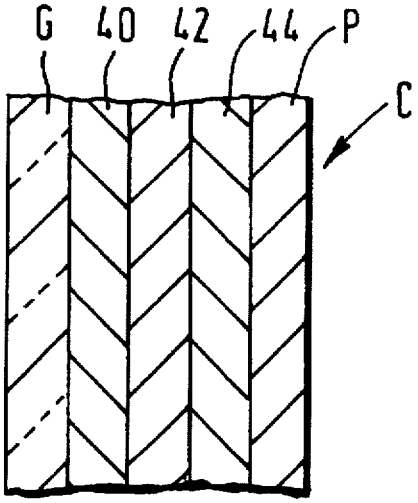
FIG. 4 is a schematic cross-sectional view of a coating used in the lamp.

The internal surface of the discharge vessel is coated with a coating C which comprises as shown in FIG. 4,

- a layer 40 of transparent electrically conductive material in direct contact with the glass as known in the art;
- a layer 42, on the conductive layer, of material which prevents the glass of the vessel 10 blackening during operation as known in the art
- a light reflective layer 44, for example Titanium Dioxide on the blackening prevention layer. The light reflective layer extends only over the surface adjacent the extension of the housing around the vessel; and
- a layer of phosphor P as known in the art.

The outer surface of the vessel under the extension of the housing has a non-continuous conductive coating of for example Aluminium thereon capacitively coupled to the conductive coating inside the vessel. The Aluminium coating is coupled to the mains to reduce electromagnetic interference.

The coating C mentioned above extends over the outer surface of the re-entrant portion 11.

Extending through the re-entrant portion 11, and through the hollow ferrite core of the solenoid 12 is an exhaust tube 17. The exhaust tube at one end is in communication with the discharge vessel. The exhaust tube extends into the housing 15, where the other end is tipped off.

Mercury amalgam 18 is held in tipped-off end of the tube 17 by a dimple or dimples 19 and a glass ball 38.

The mercury amalgam 18 is thus located at a place which, in operation is cool relative to the discharge vessel and stable in temperature to control the mercury vapour pressure in the lamp as well known in the art. In operation of the lamp the amalgam 18 is heated by heat from the discharge conducting through the re-entrant and the exhaust tube and also by heat generated by the oscillator 13 and rectifier 14. The amalgam 18 comprises mercury and an amalgam forming metal, two examples of which are Indium and a combination of Bismuth and Indium.

The lamp as described above is known from for example EP-A-646,942 and EP-A-660,375.

Such a lamp is advantageous in situations where the lamp is operated continuously for long periods, for example in some commercial premises.

However, when initially energised the light output of the lamp is visibly low and the time to reach full light output is too long for intermittent use of the lamp, for example in bedrooms and bathrooms in hotels and in domestic dwellings.

Figure 2:
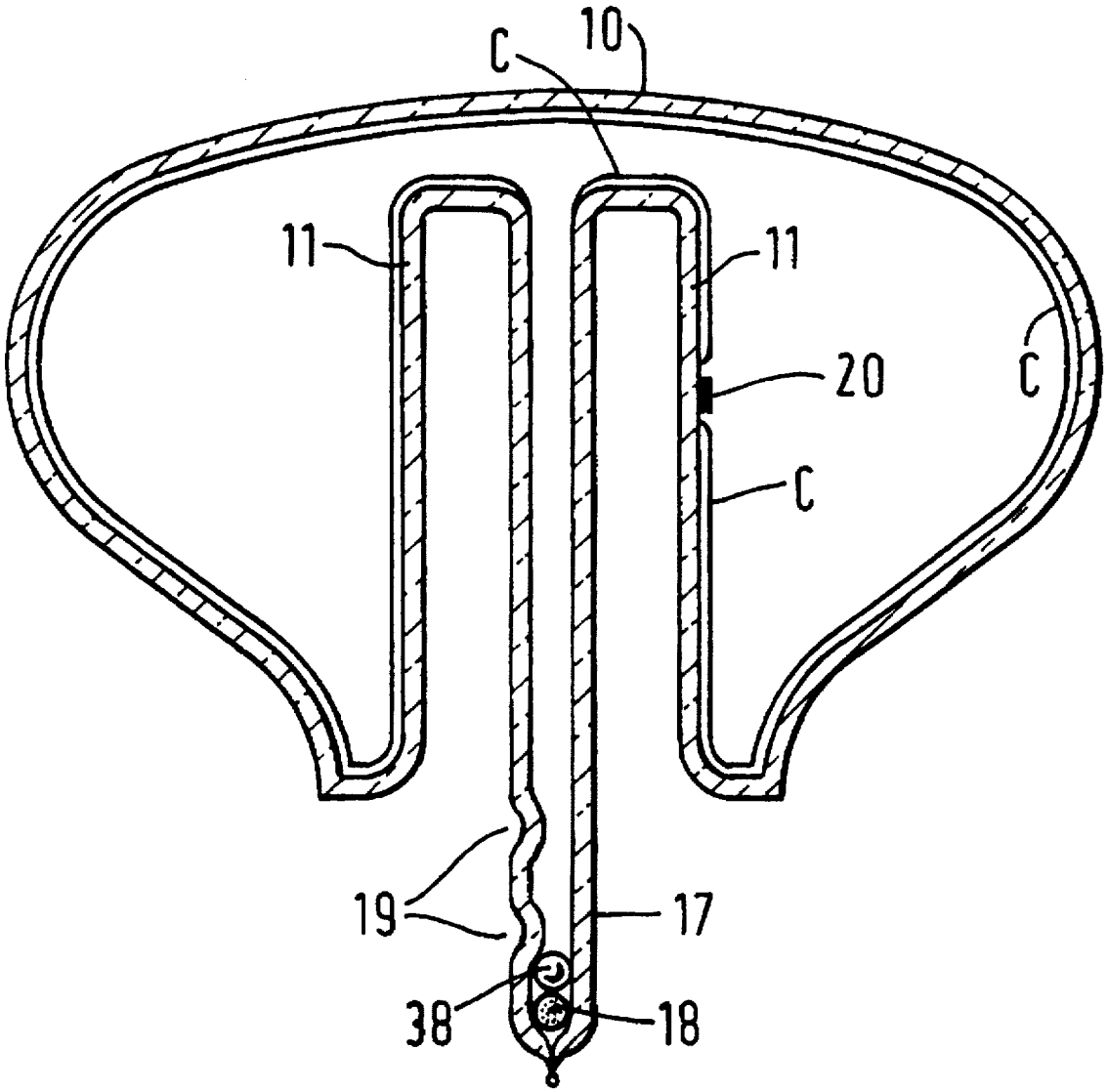
FIG. 2 is a schematic cross-sectional view of one embodiment of a discharge vessel for use in a lamp according to the invention.
Figure 3:
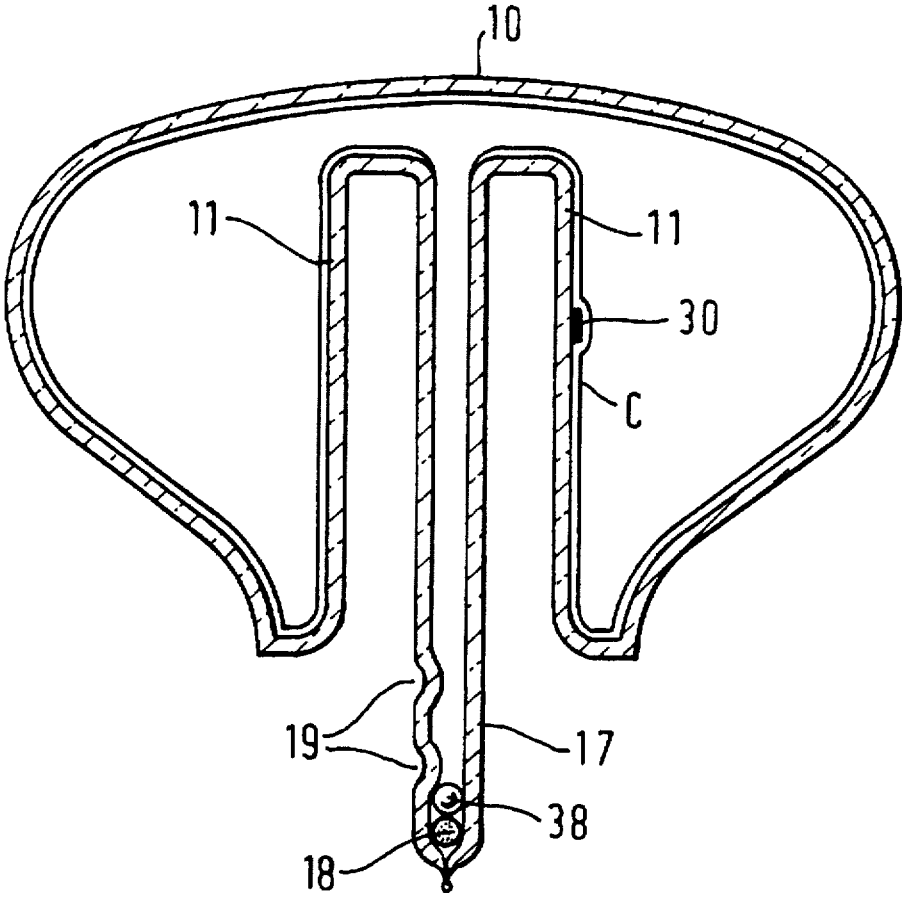
FIG. 3 is a schematic cross-sectional view of another embodiment of a discharge vessel for use in a lamp according to the invention.

In accordance with embodiments of the present invention, as shown in FIGS. 2 and 3, material which forms an amalgam with mercury vapor is placed on a part of the discharge vessel which is warmed up rapidly by the discharge when the lamp is energised. With mercury from the primary amalgam the material forms a secondary amalgam additional to the primary amalgam 18 in the tip of the exhaust tube 17.

Referring to FIG. 2, a small piece of Indium 20 is placed on an area of the re-entrant portion 11 free of coating C. The area is created by physically removing part of the coating C from the re-entrant during manufacture of the lamp.

The Indium may be approximately 2 $mm^2$ in area and weigh 2 mg. The Indium is pressed onto the glass wall of the re-entrant part.

On the first occasion of energising the lamp, usually when testing during manufacture, a discharge forms in the rare-gas fill. The heat produced by this discharge evaporates mercury from the primary amalgam into the discharge vessel. The mercury vapor pressure from the primary amalgam increases with temperature. As discussed above, the primary amalgam 18 is held in the end of the exhaust tube adjacent the energising circuit 13, 14 and mercury is released therefrom when the circuit 13, 14 heats up. In steady state, the pressure of mercury reaches close to the optimum vapor pressure of about 6 millitorr or 0.8 Pa for a mercury rare-gas discharge. When the power is turned off, the mercury vapor left in the bulb has a low probability of diffusing down the exhaust tube and combining with the primary amalgam and a high probability of combining with the secondary amalgam on the reentrant surface. In other words mercury diffuses more rapidly to the Indium than down the exhaust tube to the primary amalgam. When cooled the lamp now contains, as well as the primary amalgam, a secondary amalgam on the reentrant formed by the Indium (or other material) and the condensed mercury from the bulb. When the lamp is switched on the reentrant heats up rapidly, evaporating the mercury which had been trapped in the secondary amalgam. The quantity is sufficient to provide nearly optimum vapor pressure after a very short time: consequently the light output is also near optimum after a very short time. From the point of view of the user this shortens the run-up time from many minutes to typically less than a minute. Eventually the power from the lamp heats up the primary amalgam until that can produce optimum vapour pressure in the stabilised lamp.

Indium is advantageous as it amalgamates readily, evaporates mercury readily above 100 deg C. or so and adheres well to glass. It has a low melting point (156 deg C.) so that it melts and wets the glassware during lamp processing, and continues to do so when the lamp is operated. Furthermore, its boiling point (2000 deg C.) ensures that it does not evaporate significantly during processing, nor does it move from its intended position in lamp during long life.

Referring to FIG. 3, a small piece 30 of Indium is pressed into the glass wall of the re-entrant portion 11 before any coating C is applied thereto. The piece 30 may be 2 milligrams about 0.9 mm in diameter.

The coating C is applied to the surface of the reentrant over the piece 30 of Indium. Contrary to expectations, the coating C (which comprises several layers including at least the conductive layer, the blackening prevention layer and phosphor as discussed above) is sufficiently porous for enough mercury to be absorbed by the Indium to give rapid light run-up when the lamp is energised.

Indium may be replaced by other material which forms an amalgam with mercury and releases the mercury when heated. Preferred examples of the other suitable materials include: Bismuth; Tin; Lead; and combinations thereof with or without Indium.

The chosen material must be able to wet glass (or be capable of being stuck to glass) and form an amalgam with mercury at a much lower vapor pressure than elemental mercury at the range of temperatures of the re-entrant in operation of the lamp and a high affinity for elemental mercury when cold. Also the material must not evaporate to a significant extent during manufacture of the lamp.

If the chosen amalgam-forming material does not easily wet glass it should wet a material such as Indium which wets glass and which can act as a base. The base may then be placed on the glass and the amalgam forming material put on the base. See for example U.S. Pat. No. 4,262,231.

The invention is not limited to the electrodeless reflector lamp as disclosed herein. Those skilled in the art can apply the invention to other similar electrodeless lamps having a discharge vessel containing a re-entrant portion housing a solenoid.

We claim:

1. An electrodeless fluorescent lamp comprising a closed light transmissive discharge vessel, the vessel having a re-entrant portion housing means for producing an RF magnetic field for exciting a discharge in the vessel around the re-entrant portion, the vessel containing a primary source of mercury vapor, remote from the location of the discharge, and a layer of material on the re-entrant portion placed on a part of the discharge vessel which is warmed up rapidly by the discharge when the lamp is energized, the material forming an amalgam with mercury form the primary source and acting as an initial source of mercury vapor upon initiation of the discharge.

2. A lamp according to claim 1, wherein the said material is Indium, Bismuth, Tin, Lead or a combination of two or more thereof.

3. A lamp according to claim 1, wherein an exhaust tube extends through the re-entrant portion, the exhaust tube holding the primary source remote from the discharge vessel.

4. An electrodeless fluorescent lamp comprising a closed light transmissive discharge vessel, the vessel having a re-entrant portion housing means for producing an RF magnetic field for exciting a discharge in the vessel around the re-entrant portion, the vessel containing a primary source of mercury vapor, remote from the location of the discharge, and a layer of material is on a zone of the re-entrant portion which is free of a phosphor coating, the material forming an amalgam with the mercury from the primary source and acting as an initial source of mercury vapor upon initiation of the discharge.

5. A lamp according to claim 1, wherein the said material is coated with a coating porous to mercury vapor, the coating comprising at least phosphor.

6. A lamp according to claim 5, wherein the said porous coating comprises at least a layer of material which prevents blackening of the vessel and a layer of phosphor.

7. A lamp according to claim 6, wherein the said porous coating further comprises a layer of light reflective material.

8. An electrodeless fluorescent lamp comprising a closed discharge vessel, material on an internal wall of the vessel for forming an amalgam to act as a source of mercury vapor for a discharge in the vessel, and a coating over the material, the coating comprising at least one or more of:

a) an electrically conductive light transmissive layer;

b) a layer of material which prevents blackening of the vessel;

c) phosphor, and d) light reflective material.

9. A lamp according to claim 8, wherein the vessel is made of glass.

10. A lamp according to claim 8, wherein the material is Indium.

11. A lamp according to claim 2 wherein an exhaust tube extends through the re-entrant portion, the exhaust tube holding the primary source remote from the discharge vessel.

12. An electrodeless fluorescent lamp comprising a closed light transmissive discharge vessel, the vessel having a re-entrant portion housing means for producing an RF magnetic field for exciting a discharge in the vessel around the re-entrant portion, the vessel containing a primary source of mercury vapor, remote from the location of the discharge, and a layer of material on a zone of the re-entrant portion which is free of a phosphor coating, the material forming an amalgam with the mercury from the primary source and acting as an initial source of mercury vapor upon initiation of the discharge, the material including Indium, Bismuth, Tin, Lead or a combination of two or more thereof.

13. An electrodeless fluorescent lamp comprising a closed light transmissive discharge vessel, the vessel having a re-entrant portion housing means for producing an RF magnetic field for exciting a discharge in the vessel around the re-entrant portion, an exhaust tube extending through the re-entrant portion and holding a primary source of mercury vapor remote from the location of the discharge, and a layer of material is on a zone of the re-entrant portion which is free of a phosphor coating, the material forming an amalgam with the mercury from the primary source and acting as an initial source of mercury vapor upon initiation of the discharge.

14. A lamp according to claim 2 wherein the said material is coated with a coating porous to mercury vapor, the coating comprising at least phosphor.

15. A lamp according to claim 3 wherein the said material is coated with a coating porous to mercury vapor, the coating comprising at least phosphor.

16. A lamp according to claim 14 wherein the said porous coating comprises at least a layer of material which prevents blackening of the vessel and a layer of phosphor.

17. A lamp according to claim 15 wherein the said porous coating comprises at least a layer of material which prevents blackening of the vessel and a layer of phosphor.

18. A lamp according to claim 16 wherein the said porous coating further comprises a layer of light reflective material.

19. A lamp according to claim 17 wherein the said porous coating further comprises a layer of light reflective material.

20. A lamp according to claim 9 wherein the material is indium.

* * * * *